US006588391B2

(12) United States Patent
Gebauer et al.

(10) Patent No.: US 6,588,391 B2
(45) Date of Patent: Jul. 8, 2003

(54) DEVICE FOR ROTATING A VALVE

(75) Inventors: Klaus Gebauer, Seelze (DE); Fabrice Schneider, Barsinghausen (DE); Walter Strzoda, Barsinghausen (DE)

(73) Assignee: TRW Deutschland GmbH, Barsinghausen (DE)

( * ) Notice: Subject to any disclaimer, the term of this patent is extended or adjusted under 35 U.S.C. 154(b) by 0 days.

(21) Appl. No.: 10/058,613

(22) Filed: Jan. 28, 2002

(65) Prior Publication Data

US 2002/0100449 A1 Aug. 1, 2002

(30) Foreign Application Priority Data

Jan. 26, 2001 (DE) ..... 101 03 578

(51) Int. Cl.[7] ..... F02N 3/00
(52) U.S. Cl. ..... 123/188.9; 123/196 R; 123/90.3
(58) Field of Search ..... 123/196 R, 188.9, 123/90.28–90.3

(56) References Cited

U.S. PATENT DOCUMENTS 3,892,210 A * 7/1975 Kuhn et al. ..... 123/90.3
5,727,507 A * 3/1998 Johansson ..... 123/90.3

* cited by examiner

*Primary Examiner*—Tony M. Argenbright
*Assistant Examiner*—Katrina B. Harris
(74) *Attorney, Agent, or Firm*—Collard & Roe, P.C.

(57) ABSTRACT

A device for rotating a valve for producing rotations of a gas charging valve in an internal combustion engine during its opening and closing movements. The device has a basic body having a plurality of pockets oriented in a peripheral direction for receiving rolling bodies. There is also a valve shaft disposed in the basic body. In addition, there is also a plurality of rolling bodies and a plurality of tangential springs for holding the plurality of rolling bodies adjacent to the plurality of pockets on the basic body. Finally, there is a cover serving as a valve spring support and force transmitter or energy reservoir for each of the valve rotations, wherein the basic body and the cover consist of reshaped metal components. This design allows for a simple construction process resulting in lower manufacture costs.

9 Claims, 4 Drawing Sheets

DETAIL Z
90° ROTATED
B
B
B-B
2
11

X
A
Z
B
B

VIEW X
1
2
1a
1b
A-A
1a
1
2
1b

A
1

FIG. 9
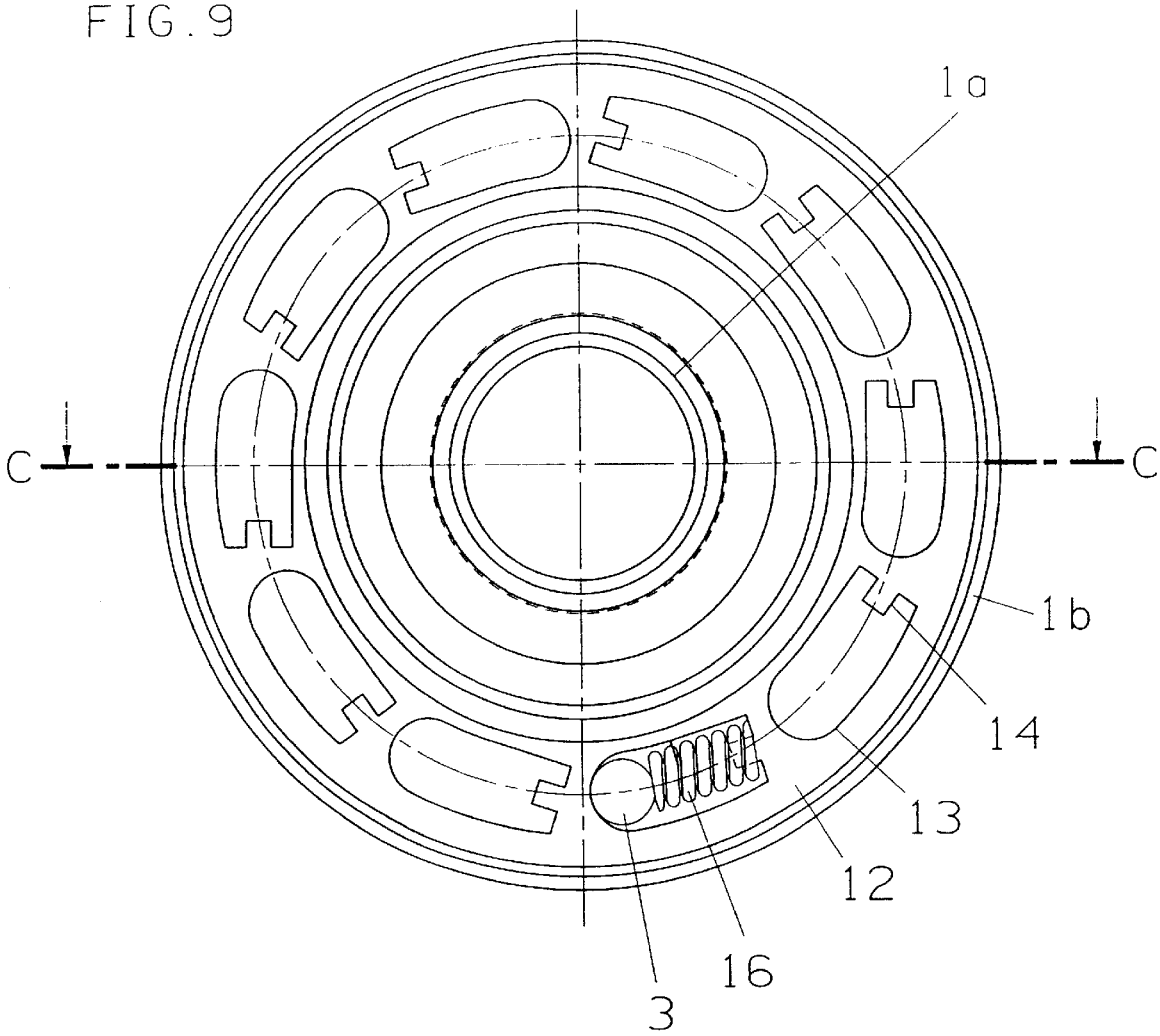
C-C
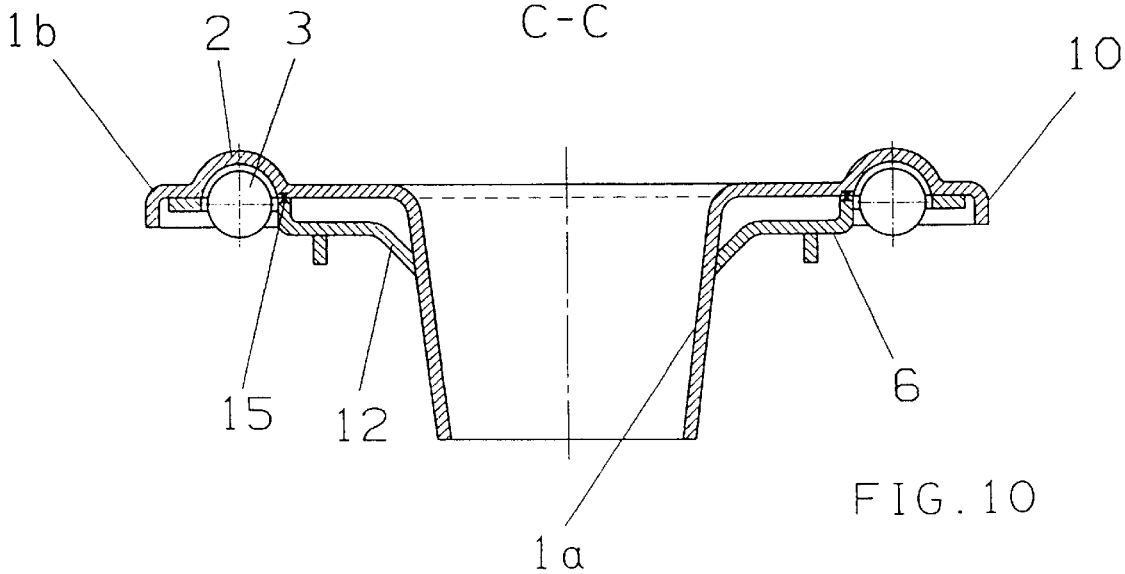
FIG. 10

DEVICE FOR ROTATING A VALVE

BACKGROUND OF THE INVENTION

Field of the Invention

The present invention relates to a device for rotating a valve that forcibly produces rotations of a gas changing valve in an internal combustion engine. This valve rotation is in the course of the gas changing valve's opening and closing movements. The valve comprises a basic body surrounding the valve shaft, that is connected with the shaft in a force-transmitting manner. This basic body has a plurality of pockets oriented in a circumferential or peripheral direction for receiving roller bodies initially tensioned by tangential springs. In addition, this design also contains a cover which acts as a valve spring support. There is also a cup spring clamped between the basic body and the cover that serves as a force transmitter or energy reservoir for the valve rotations.

The components "basic body" and "cover" of the device are produced in one or more stages by a cold flow pressing method. This method requires complicated dies whose useful life is determined by the material used and the required reshaping forces. The cold flow pressing process has to be performed in many steps with intermediate annealing. After this process, cutting steps are still required to produce a plurality of defined functional surfaces. This result means that there are high production costs for the device components. Thus, the aim of this invention is to reduce the manufacturing costs without causing any negative effects on the rigidity, function and duration of the useful life of the device.

SUMMARY OF THE INVENTION

The invention relates to a device for rotating a valve that has a basic body that embraces the valve shaft. The basic body has a plurality of pockets oriented in a circumferential or peripheral direction, With this invention, the basic body and cover of the device can be produced by a simpler production method and at a more favorable cost. In this case, the basic body and the cover of a device are made of re-formed sheet metal parts.

The basic body and the cover, which are made of a steel sheet, limit the re-shaping process to the important functional surfaces such as the cone, the cup spring support, and the ball raceway. The functional surfaces that are of secondary importance, are replaced by smaller individual surfaces, which are uniformly distributed over the circumference and slightly bent. Thus, it is possible to reduce the required cutting procedures to very few operations for adjusting defined measurements of the finished product.

The number of necessary requirements and the cost with respect to the tool for producing the pressed metal sheet components can thereby be substantially reduced. The recesses of the roller body pockets are slightly pressed only proportionally. Thus, this design results in a considerable cost savings.

The pockets can be formed in different ways, either similar to the shape commonly used at the present time, or by lining up a plurality of different bevels. The gaps between the pockets, which are conditioned by the process, are closed by simple construction elements which maintain the tangential springs within the pockets in their positions at the same time. These construction elements, which can be pins or stops, can also be connected in the form of a ring and combined to form one single component.

This design ensures a substantially enhanced exchange of lubricant by the openings between the ball pockets.

The stiffenings required for the stability of the pocket rim of the basic body versus the cone are shaped into the sheet metal body. The basic body has additional stability provided by grooves or steps extending all around.

The material consumption and thus also the moving components are substantially reduced in this manner. The material used should be suitable for the hardening process and at the same time well-suited also for the re-forming process, The cover is produced in the form of a simple pressed component as well. The steps extending all around are not complete in this connection, but produced only as individual bent tongues or steps uniformly distributed over the circumference.

The device for rotating a valve can be closed after its individual components have been assembled by bending individual tongues against the basic body.

Starting with a flat disk, the basic body is produced by molding the cone and pressing all pockets into its flange-like rim. As the pockets are being pressed in, their ends are separated from the beginning of the next pocket, so that a gap is produced. The gaps may be narrower than the bridges used before, which means that either the pitch circle and thus the construction space can be selected smaller with the same load, or the size of the rolling bodies, such as balls can be selected larger.

Simple construction elements can be used as stop means for the tangential springs in the pockets. These construction elements prevent the springs from slipping. This result can be realized by mounting a separate sheet metal ring with stop tongues reaching into the pockets.

After the balls, the tangential springs, and their holding components have been mounted, the cover is positioned after the cup spring has been put into place, and then fixed by only bending over individual segments along the circumference.

BRIEF DESCRIPTION OF THE DRAWINGS

Other objects and features of the present invention will become apparent from the following detailed description considered in connection with the accompanying drawings which discloses at least one embodiment of the present invention. It should be understood, however, that the drawings are designed for the purpose of illustration only and not as a definition of the limits of the invention.

In the drawings, wherein similar reference characters denote similar elements throughout the several views:

FIG. 9 is a top view of a basic body with the mounted holding ring; and

FIG. 10 is the section C—C through the components according to FIG. 9.

DETAILED DESCRIPTION OF PREFERRED EMBODIMENTS

Figure 1:
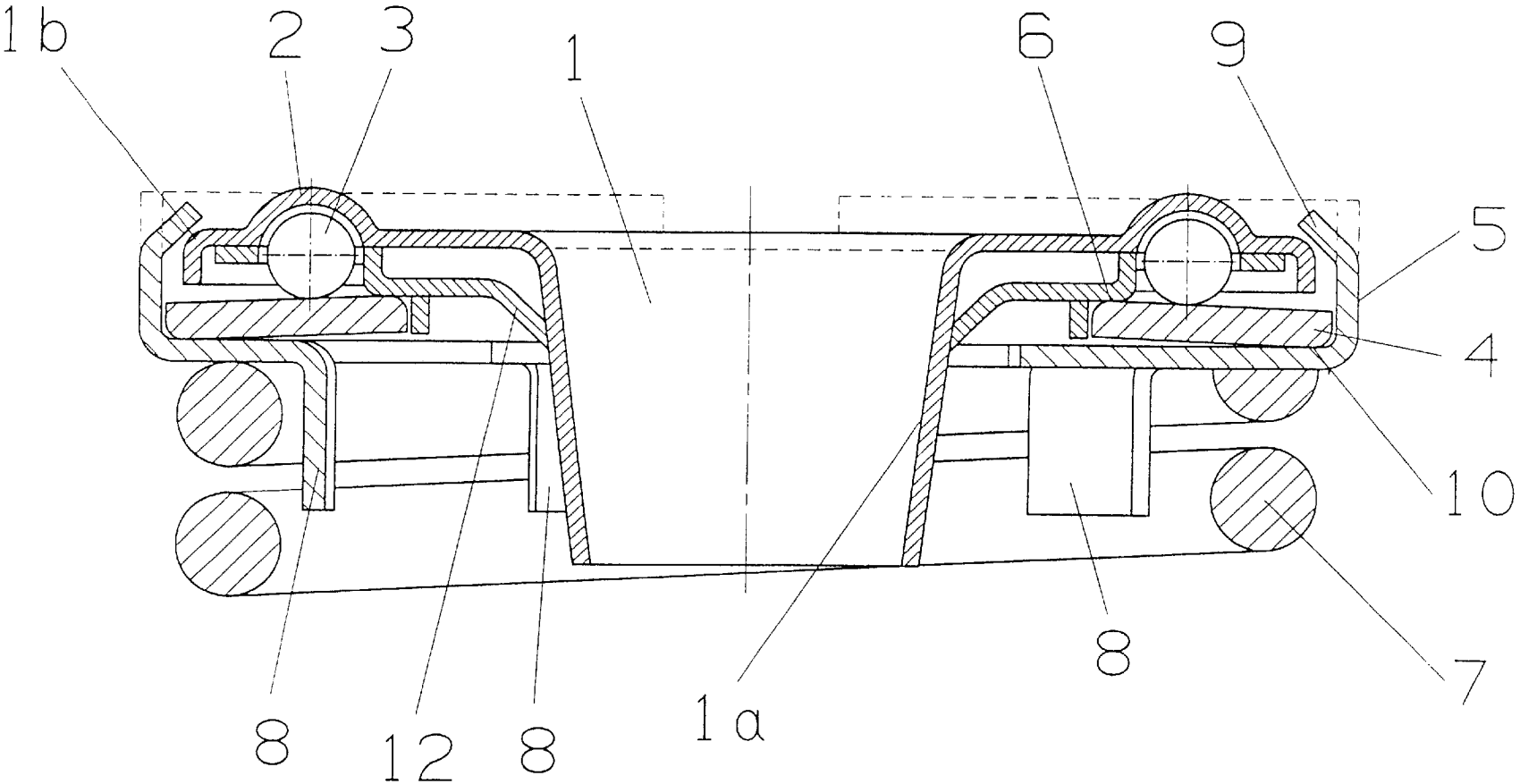
FIG. 1 shows a radial cross section through the device for rotating a valve.

In the drawings, FIG. 1 shows a basic body 1 made of a reshaped sheet metal ring. Basic body comprises a cone 1*a*, a pocket 2 pressed into basic body 1 adjacent to a flange-like rim 1*b*. Pocket 2 is for receiving a steel ball 3 arranged in the pocket as the rolling body. A cup spring 4 retains balls 3 in their pockets 2. Cup spring 4 supports itself with its outer edge on the inner side of a cover 5 made of sheet metal by non-cutting shaping, whereas its inner edge is supported on a cup spring support 6. Cup spring support 6 is either molded in the form of a step extending all around, or consists of a plurality of flat steps which are distributed over the circumference and shaped from the basic body.

Valve spring 7 supports itself with one end on support surface 10 of cover 5. To keep the valve spring centered during operation, cover 5 has a plurality of axially extending tongues 8 which are distributed over its circumference. After the individual components of the device have been assembled, cover 5 embraces the outer edge of basic body 1 with a plurality of tabs or tongues 9 distributed over its circumference. Tongues 9 are limited to the required minimum number as well.

Figures 2, 3, 4, 5:
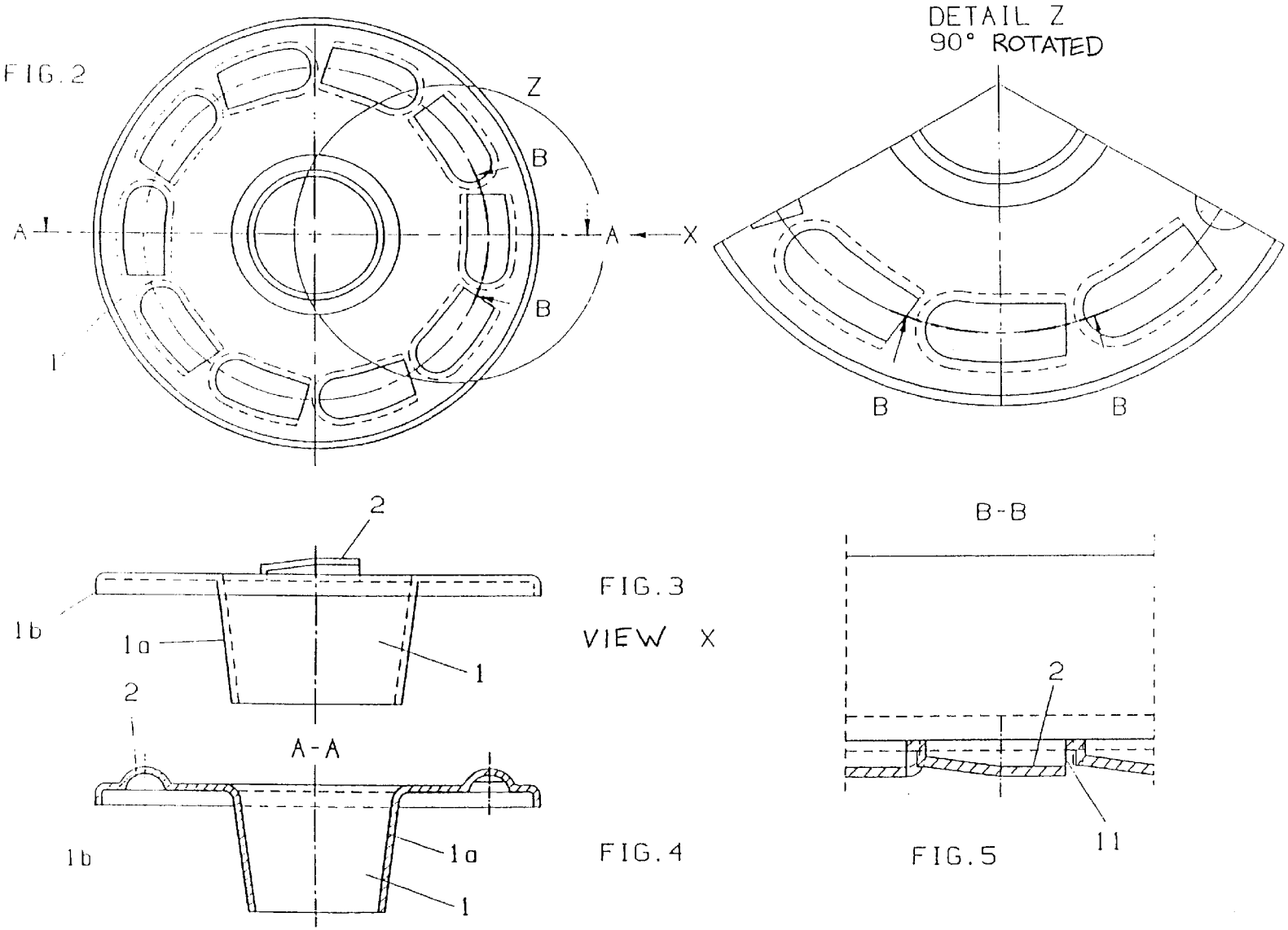
FIG. 2 is a top view of a basic body.
FIG. 3 is a side view of the basic body according to FIG. 2.
FIG. 4 is a view of the section A—A of the representation according to FIG. 2.
FIG. 5 is a view of the section B—B through the representation according to FIG. 2.
Figure 6:
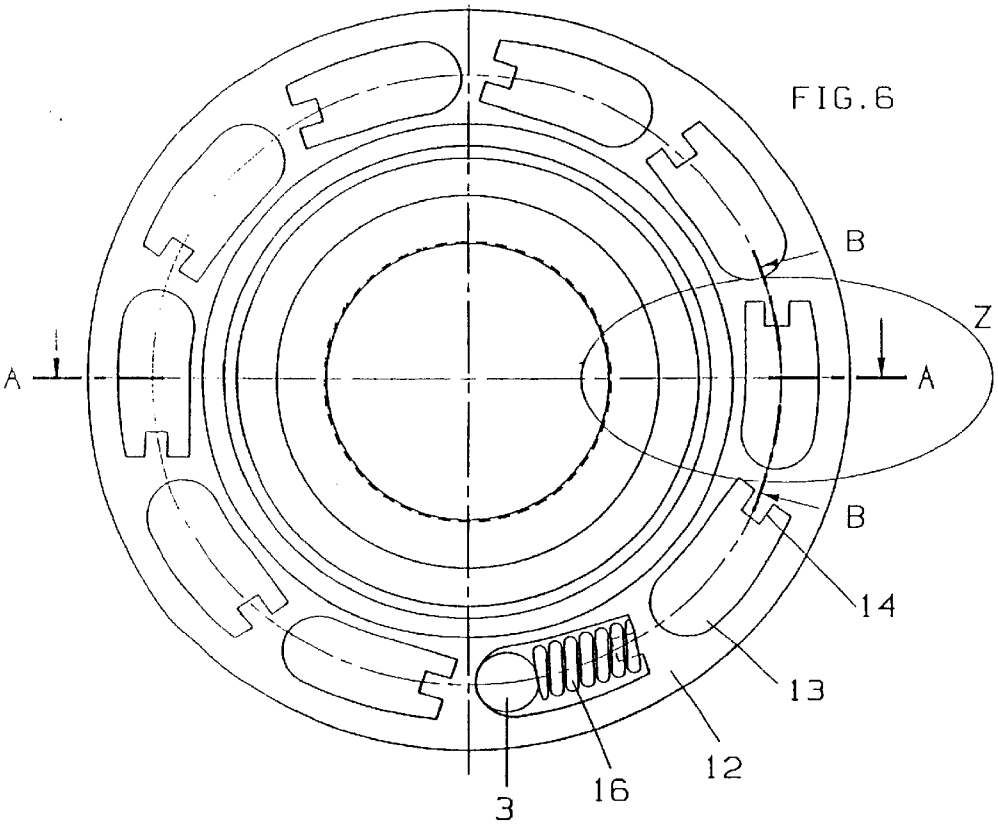
FIG. 6 is the top view of a ring with molded-on holding elements for positioning the tangential springs in the ball pockets.
Figure 8:
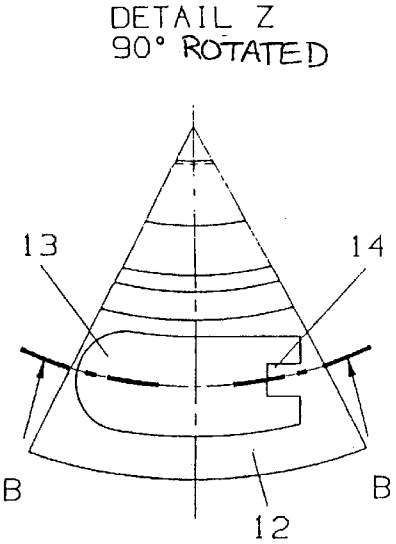
FIG. 8 is a view of the section B—B through a holding ring according to FIG. 6.
Figure 7:
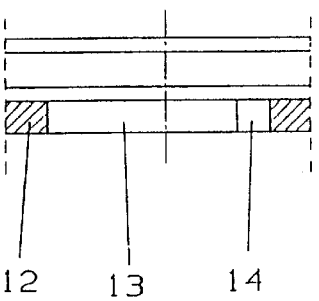
FIG. 7 is a view of the section A—A through a holding ring according to FIG. 6.
Figure 7:
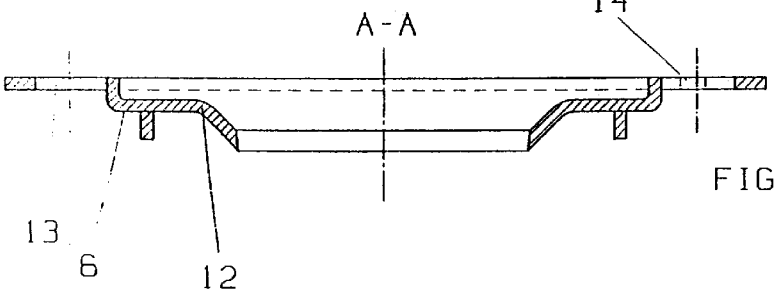

From pocket rim 1*b* of basic body 1, pockets 2 may be pressed out of the plane of the pocket rim so that a gap 11 (See FIG. 5) is produced at each of their ends in relation to the neighboring pocket. This design creates a substantially enhanced exchange of lubricant. However, a spring may be disposed in this zone which is supported via a pin or tongue-shaped stop means reaching into the pocket. These stops may be part of a separate ring 12 (See FIGS. 6 and 7). This ring has punched-out openings 13, which, when the ring is mounted on basic body 1 as shown in FIG. 10 these openings 13, are congruent with the contours of pockets (2) of the rolling body. Within the zone of gaps 11 (FIG. 5), openings 13 have punched tongues 14, which also may be bent at right angles to provide support for the inserted tangential springs 16 in the area of gaps 11.

Rings 12 are placed on the basic body in the manner shown in FIGS. 9 and 10 and connected with this body in a fixed manner. Rings 12 can be attached by means of welding humps (or bulges) 15. Tangential springs 16 are prevented from slipping from gaps 11 by tongues 14 and are guided at the same time. With their front ends, balls 3 always press themselves into the upper position of the raceways within the pockets as soon as the pressure of cup springs 4 diminishes as the valve is being actuated, and the balls are released.

Accordingly, while a few embodiments of the present invention have been shown and described, it is to be understood that many changes and modifications may be made thereunto without departing from the spirit and scope of the invention as defined in the appended claims.

What is claimed is:

1. A device for rotating a valve for producing rotations of a gas charging valve in an internal combustion engine during its opening and closing movements comprising:

a) a basic body having a cone section and having a plurality of pockets oriented in a circumferential direction for receiving rolling bodies, and a valve shaft disposed in said basic body;

b) a plurality of rolling bodies disposed in said plurality of pockets;

c) a plurality of tangential springs disposed in said plurality of pockets, said tangential springs for holding said plurality of rolling bodies adjacent to said plurality of pockets on said basic body; and d) a cover coupled to said basic body, said cover serving as a valve spring support and force transmitter or energy reservoir for each of the valve rotations, said cover having a cup spring support, wherein said cone section, said cover with said cup spring support, and said pockets forming a raceway for said rolling bodies consist of reshaped metal components.

2. The device as in claim 1, wherein said basic body consists of a conically pressed sheet metal section and a flange edge extending all around, wherein said plurality of pockets are pressed into said basic body adjacent to said flange edge.

3. The device as in claim 2, wherein said basic body further comprises a plurality of punched-out openings and punched out formed tongues as simple construction elements, wherein a plurality of gaps between said plurality of pockets are closed by said punched out openings and said punched out tongues which keep said tangential springs in position.

4. The device as in claim 1, wherein said basic body and said cover are formed from a hardenable material.

5. The device as in claim 1, wherein said individual functional surfaces comprising said cone, said cover, said cup spring support, and said plurality pockets all have a wear inhibiting treatment.

6. The device as in claim 1 wherein said cover has a plurality of functional elements which are punched tongues and steps arranged uniformly distributed over its circumference.

7. The device as in claim 3, further comprising a separate holding ring which has functional elements for holding and guiding said tangential springs wherein said ring rests on said basic body.

8. The device as in claim 7, wherein said separate holding ring is joined with said basic body, via a hump or bulge welding.

9. The device as in claim 7, wherein said holding ring increases a stiffness of said functional elements wherein said elements are connected with said basic body by joining or welding.

* * * * *